US006119272A

United States Patent [19]

Tebbe

[11] Patent Number: 6,119,272

[45] Date of Patent: Sep. 19, 2000

[54] NURSING GLOVE

[75] Inventor: Gerold Tebbe, Monaco, Monaco

[73] Assignee: Deotexis, Inc., Germany

[21] Appl. No.: 08/910,239

[22] Filed: Aug. 13, 1997

[30] Foreign Application Priority Data

Aug. 12, 1996 [DE] Germany ..... 196 32 312

[51] Int. Cl.[7] ..... A41D 19/00

[52] U.S. Cl. ..... 2/161.7; 15/227

[58] Field of Search ..... 2/16, 158, 161.7, 2/162, 167, 161.6, 161.8; 15/227

[56] References Cited

U.S. PATENT DOCUMENTS

| | | | |
|---|---|---|---|
| Re. 35,814 | 6/1998 | Olson | 15/227 |
| 4,902,283 | 2/1990 | Rojko et al. | 2/167 |
| 4,935,260 | 6/1990 | Shlenker | 2/161.7 |
| 5,020,159 | 6/1991 | Hellickson | 2/167 |
| 5,196,244 | 3/1993 | Beck | 2/158 |
| 5,649,336 | 7/1997 | Finch et al. | 15/227 |

FOREIGN PATENT DOCUMENTS

| | | |
|---|---|---|
| 68 10 691 | 6/1968 | Germany . |
| 25 54 589 | 6/1976 | Germany . |
| 27 57 130 | 7/1978 | Germany . |
| 86 16 040 | 11/1986 | Germany . |

*Primary Examiner*—John J. Calvert
*Assistant Examiner*—Katherine Moran

[57] ABSTRACT

A nursing glove comprises two film layers (14, 16) that are welded to each other along three sides of a rectangle and that are joined to a working layer consisting of natural fiber material.

29 Claims, 3 Drawing Sheets

NURSING GLOVE

Figure 1:
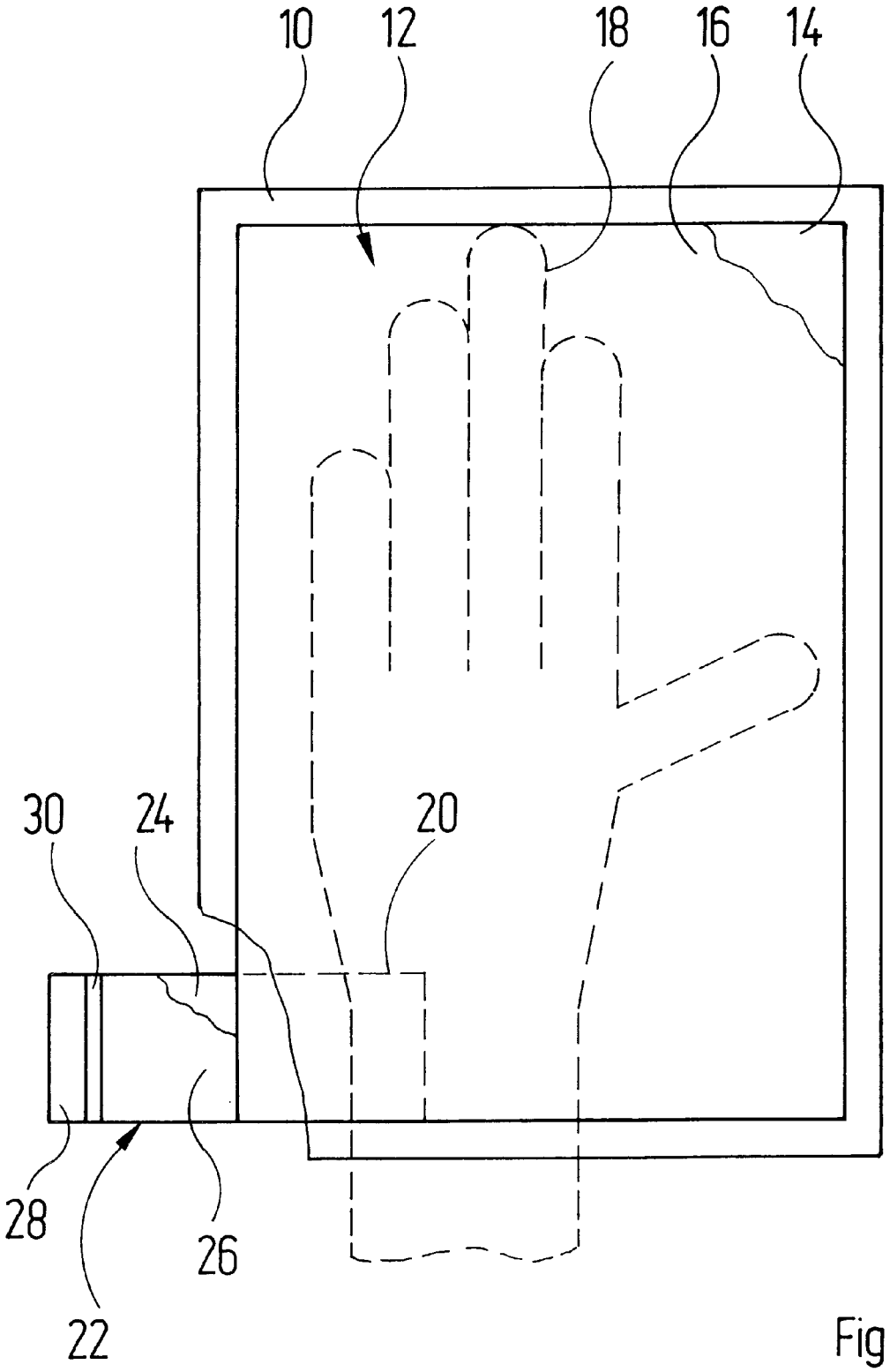

The invention relates to a nursing glove according to the precharacterizing clause of claim 1.

Such nursing gloves are known in the form of rubber gloves. The latter fit relatively tightly on the hand of the user and cannot be put on and taken off quickly. Such gloves are also relatively expensive.

By means of the present invention, therefore, a nursing glove according to the pre-characterizing clause of claim 1 is to be so developed that it is more favorably priced and can be put on and taken off quickly.

That problem is solved according to the invention by a nursing glove having the features specified in claim 1.

The nursing glove according to the invention consists of a foundation material that can be manufactured in large quantities and very inexpensively, namely film material. Two layers of such a film material are, for example, simply welded together along three weld lines, forming three sides of a rectangle, to produce a pocket. In that manner, a glove resembling a wash-cloth or a mitten is obtained which can be used for hands of different sizes in like manner. In known manner, the welds may at the same time serve to separate successive pockets obtained by intermittent or continuous welding of superimposed webs of film.

Advantageous developments of the invention are specified in subclaims.

A nursing glove of the kind specified in claim 2 has a pleasant feel for the patient being tended.

In that connection, the development of the invention according to claim 3 is found to be especially soft and kind to the skin.

In the case of a nursing glove according to claim 4, the layer that comes in contact with the skin of the patient consists of natural fibers.

The development of the invention according to claim 5 is advantageous with regard to improving the mechanical stability under load with the working layer and with regard to the welding of the working layer to the film material.

The development of the invention according to claim 6 allows the working layer to be securely joined to the film material without the additional use of a bonding agent.

A nursing glove according to claim 7 can be used for different tasks, for example for rubbing dry and putting on cream, simply by being turned.

If film materials having the thicknesses specified in claim 8 are used, the nursing glove is not only sufficiently flexible and favorably priced but also sufficiently impermeable to bacteria and viruses.

The choice of the film material according to claim 9 is advantageous with regard to pleasant wearing properties for the user.

The developments of the invention according to claims 10 and 11 are advantageous with regard to keeping the nursing glove sterile until the time of use.

A nursing glove according to claim 12 can be fastened rapidly and reliably to the hand of the user in a simple manner.

In the case of a nursing glove according to claim 13, pieces of nonwoven fabric or cotton wool etc. can easily be joined to the surface of the glove in a manner similar to that of a burr-and-loop fastening.

The holding hooks of the burr-and-loop fastening according to claim 14 can be produced in an especially simple manner.

Figure 2:
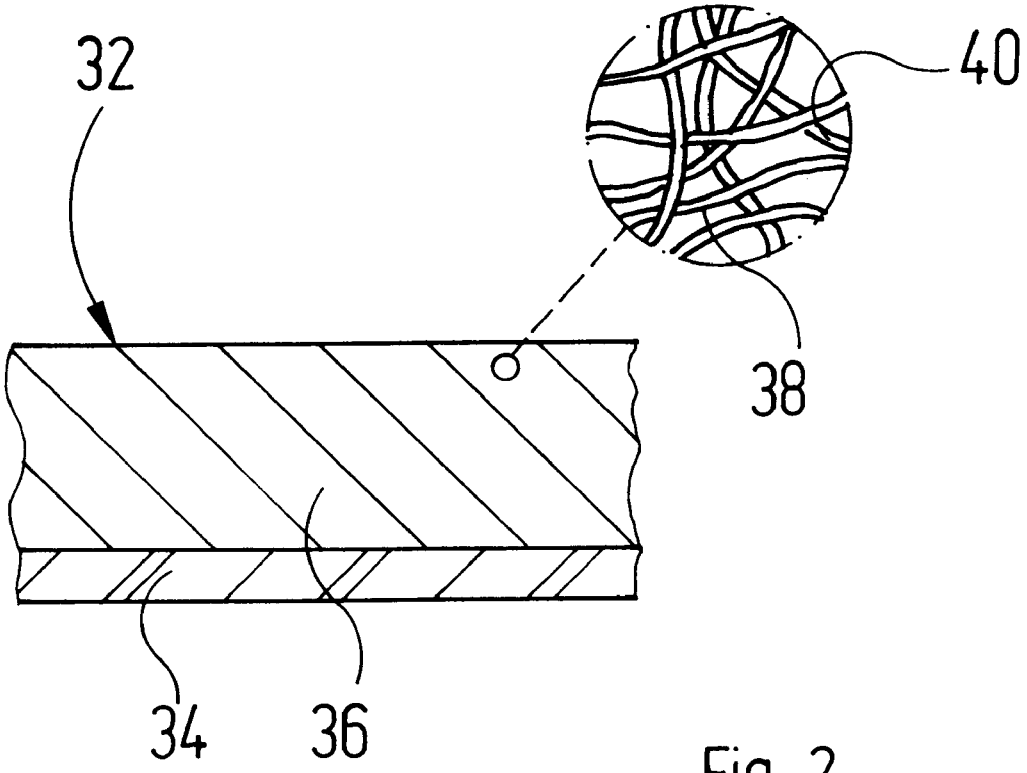
Figure 3:
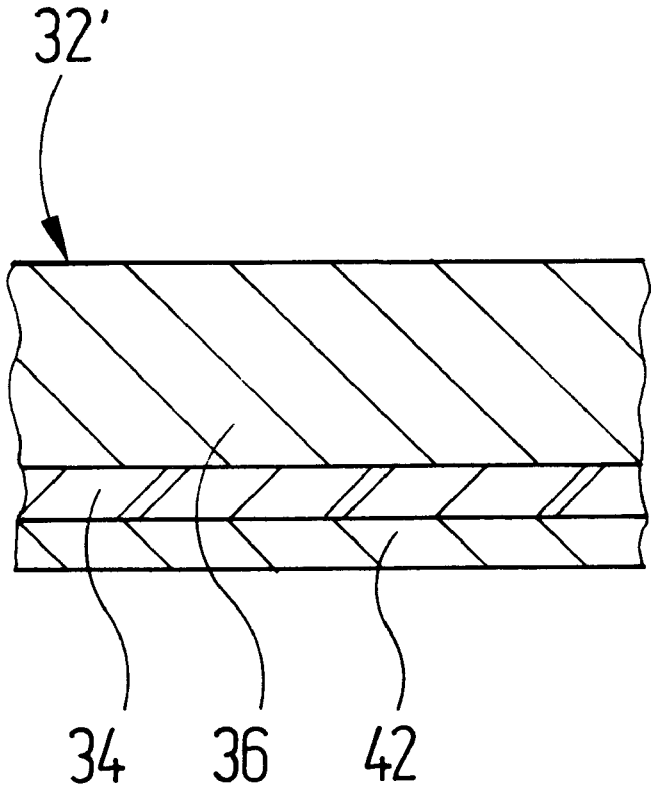
Figure 4:
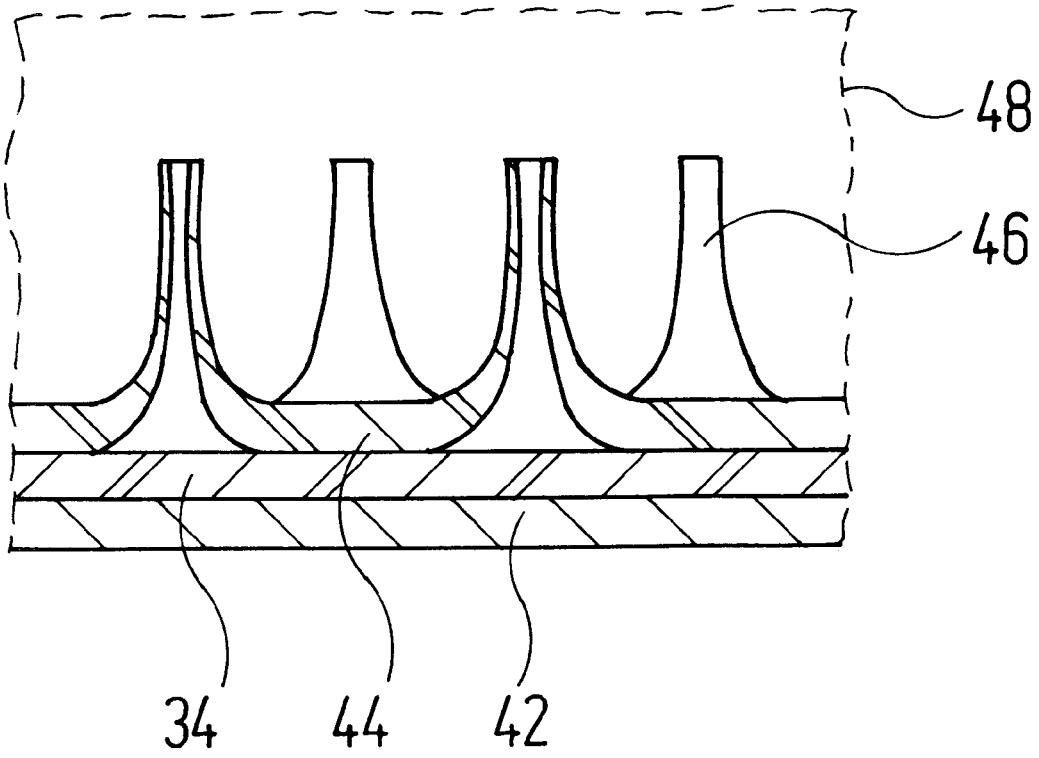

The invention is described in detail below with the aid of illustrative embodiments with reference to the drawings, in which:

FIG. 1: is a plan view of a film pack with a nursing glove disposed therein and with a hand indicated, a number of parts having been broken away, FIG. 2: shows a greatly enlarged section through the material from which the nursing glove shown in FIG. 1 is made;

FIG. 3: is a view similar to FIG. 2, showing a modified composite material for making the nursing glove; and FIG. 4: is a view similar to FIG. 2, showing a further modified material for making nursing gloves.

In FIG. 1, reference numeral 10 denotes a film bag impermeably welded at the edge, the interior of which is filled with ethylene dioxide gas. Disposed in the interior of the film bag is a nursing glove, designated 12 in its entirety, which has a shape of a wash-cloth. Two layers of film 14, 16 are welded to each other at the upper, left-hand and right-hand edges in FIG. 1, while the lower edges thereof define a pocket opening. The hand of a user, indicated by a dashed line at 18, can be inserted into the interior of the nursing glove 12 through that pocket opening.

A fastening portion 20 of a self-adhesive closure strap 22 is stuck to the rear film layer 14. The adhesive layer 24 of the closure strap 22 is covered by a first cover paper 26 and a second cover paper 28 in such a manner that a narrow strip 30 of the adhesive layer 24 remains exposed between them. By means of that narrow strip the closure strap 22 is fastened to the front film layer 16 for dispatch purposes. For use, the closure strap 22 is pulled away from the film layer 16 so that it adopts the position shown in FIG. 1. Then, the larger cover paper 26 is removed and, after the nursing glove 12 has been put on, the film material is gathered around the wrist of the user and fastened with the closure strap 22 so that the nursing glove 12 is held securely on the hand of the user. The remaining cover paper 28 allows the adhesive closure to be opened again so that the nursing glove can be taken off.

As will be seen from FIG. 2, the nursing glove 12 is made from a composite material designated 32 in its entirety. The latter consists of a thin flexible separation layer 34 and a thick absorbent working layer 36 firmly attached to the outside thereof In practice, the separation layer 34 is preferably an approximately 5 $\mu$m to 50 $\mu$m thick including 10 and 20 $\mu$m thick polypropylene film. The working layer 36 is in practice a from 500 $\mu$m to 5000 $\mu$m thick nonwoven layer of cellulose fibers 38 or cotton.

The working layer 36 can additionally contain a proportion of polypropylene fibers 40 in order to improve the mechanical strength of the nonwoven layer and its weld ability to the separation layer 34.

The composite material 32' shown in FIG. 3 substantially corresponds to that shown in FIG. 2 except that there is applied to the inside of the separation layer 34, in addition, a further working layer 42 of cellulose or cotton fibers, which makes the feel of the glove more pleasant for the user and is able to absorb perspiration.

As a further modification of the invention, it is possible to use in a nursing glove different composite materials 32 for the front side and the rear side, which differ in the thickness of the working layer 36 and/or in the kind of materials used therein. For example, one side of the glove may be in the form of a hydrophilic absorbent side while the other may be in the form of a hydrophobic side.

The manufacture of the nursing glove described above can be carried out in the following manner:

First, the natural fiber working layers 36 or 36 and 42 are thermally laminated to polypropylene film webs having a thickness of 10 $\mu$m. In that procedure, the working layers may be joined to the separation layer 34 throughout or only in adherent regions.

Then, using intermittently moved welding heads or rotating welding drums, the three sides of the nursing glove 12 are welded together. Then the nursing gloves 12 are separated from one another if that has not already taken place by means of the welds.

The nursing gloves so completed are sealed in the film bags 10 under ethylene oxide gas.

If desired, the film webs can also be stuck together at the pocket edges and the nursing gloves can be separated from one another using a knife or a cutting drum.

FIG. 4 shows a separation layer 34 formed by a film to which a burr layer 44 is attached, for example welded or glued on at points or over an area. The burr layer 44 has a plurality of fiber-like holding elements 46 which are able to hook into a layer 48 of nonwoven material or cotton wool laid thereover. The holding elements 46 are produced, for example, by passing a film of thermoplastic material over a needle roller or by pulling the holding elements out of such a film using a matrix arrangement of hot needles. The second side of the separation layer 34 is again covered with a working layer 42 that is kind to the skin.

If one side of a nursing glove is produced with the composite material shown in fig. 4, the user himself can easily create a working layer suited to the particular nursing task by attaching a nonwoven fabric or cotton wool and can re-new or change that working layer when required.

What is claimed is:

1. Nursing glove comprising a flexible material that is impermeable to bacteria and viruses, characterized in that the flexible material is a composite film material and two layers (14,16) of the composite film material are welded or stuck together to form a pocket which is open at one side and which has a substantially rectangular outline, and that a front side and rear side of said nursing glove have working layers (36) that differ from each other in at least one characteristic chosen from the group consisting of their thickness, their mechanical structure, and their materials.

2. Nursing glove according to claim 1, characterized in that said composite film material comprises a separation layer (34) that is covered with at least one of said working layers (36, 42) that is an absorbent layer.

3. Nursing glove according to claim 2, characterized in that one of said layers (36, 42) comprises a nonwoven material.

4. Nursing glove according to claim 2, characterized in that said working layer (36, 42) comprises fibers chosen from the group consisting of cellulose and cotton fibers.

5. Nursing glove according to claim 2, characterized in that at least one of said working layers (36, 42) include a proportion of synthetic fibers.

6. Nursing glove according to claim 2, characterized in that the working layer (36, 42) is at least partially welded or stuck to the separation layer (34).

7. Nursing glove according to claim 1, characterized in that a separation layer (34) of said composite film material has a thickness of from 5 $\mu$m to 50 $\mu$m.

8. Nursing glove according to claim 1, characterized in that the composite film material comprises a polypropylene film.

9. Nursing glove according to claim 1, characterized by an enclosure (10) that individually encloses said nursing glove.

10. Nursing glove according to claim 9, characterized in that the enclosure (10) is filled with a sterilizing gas.

11. Nursing glove according to claim 1, characterized by a self-adhesive closure strap (22) provided at an open end of the pocket.

12. Nursing glove according to claim 1, characterized in that at least one of the layers (14, 16) is in the form of a burred layer at least in a portion thereof.

13. Nursing glove according to claim 12, characterized in that holding elements (46) of the burred layer are formed by pulled-out portions of a film (44).

14. A nursing glove of a flexible material that is impermeable to bacteria and viruses, in which said flexible material comprises a film material, two layers (14, 16) of said film material are fixed together to form a pocket that is open at one side, at least one of the outside and inside of said film material is covered with a working layer (36, 42) and a self-adhesive closure strap (22) is provided at said open side of said pocket.

15. The nursing glove according to claim 14, in which said film material (34) has a thickness of approximately 5 $\mu$m to 50 $\mu$m.

16. The nursing glove according to claim 15, in which said separation layer (34) has a thickness of approximately 20 $\mu$m.

17. The nursing glove according to claim 14, in which said film material (34) comprises a polypropylene film.

18. The nursing glove according to claim 14, in which an enclosure (10) encloses said nursing glove in an impermeable manner.

19. The nursing glove according to claim 14, in which an enclosure (10) encloses said nursing glove and additional working gloves in an impermeable manner.

20. The nursing glove according to claim 14, in which an enclosure (10) is filled with a sterilizing gas.

21. The nursing glove according to claim 20, in which said sterilizing gas is ethylene oxide.

22. A nursing glove comprising a flexible material that is impermeable to bacteria and viruses, wherein said flexible material comprises a film material and two layers (14, 16) of said film material are welded or stuck together to form a pocket that is open at one side, at least one of the film material is covered with a working layer (36, 42), said working layer (36, 42) comprises cellulose fibers or cotton fibers and a proportion of synthetic fibers, and is at least partially welded or stuck to a separation layer (34) of said film material, and said separation layer (34) has a thickness of from approximately 5 $\mu$m to approximately 50 $\mu$m.

23. The nursing glove according to claim 22, in which said working layer (36, 42) comprises a non-woven material.

24. The nursing glove according to claim 22, in which said separation layer comprises a polypropylene film.

25. The nursing glove according to claim 22, further comprising an enclosure (10) which encloses said nursing glove in an impermeable manner.

26. The nursing glove according to claim 25, in which said enclosure (10) is filled with a sterilizing gas.

27. The nursing glove according to claim 22, further comprising a self-adhesive closure strap (22) provided at an open end of said pocket.

28. The nursing glove according to claim 22, wherein at least one of said layers (14, 16) is in the form of a burred layer at least in a portion thereof.

29. The nursing glove according to claim 28, in which holding elements (46) of said burred layer are formed by pulled-out portions of a film (44).

* * * * *